US005145083A

United States Patent [19]

Takahashi

[11] Patent Number: 5,145,083

[45] Date of Patent: Sep. 8, 1992

[54] CAP DEVICE FOR MOUTHPIECE OF CONTAINER AND METHODS OF SEALING MOUTHPIECE PORTION OF CONTAINER AND OPENING THE SAME

[75] Inventor: Yutaka Takahashi, Tokyo, Japan

[73] Assignee: Kirin Beer Kabushiki Kaisha, Tokyo, Japan

[21] Appl. No.: 573,625

[22] Filed: Aug. 27, 1990

[30] Foreign Application Priority Data

Aug. 28, 1989 [JP] Japan ..... 1-220827
Mar. 12, 1990 [JP] Japan ..... 2-24537

[51] Int. Cl.[5] ..... B65D 51/16

[52] U.S. Cl. ..... 220/206; 220/203; 220/258; 220/359; 215/232; 215/260; 215/347; 215/349; 222/105; 222/494; 222/496; 222/509; 137/614.2; 251/149.6

[58] Field of Search ..... 220/203, 206, 209, 359, 220/361, 450, 453, 461, 468, DIG. 32, DIG. 33, 258; 215/347, 349, 232, 260; 222/105, 183, 494, 496, 501, 509; 137/614.2; 251/149.6

[56] References Cited

U.S. PATENT DOCUMENTS

| | | | |
|---|---|---|---|
| 1,260,502 | 3/1918 | Wood | 137/614.2 |
| 1,862,794 | 6/1932 | Lamb | 222/496 |
| 1,874,914 | 8/1932 | Crowley | 137/614.2 |
| 2,755,974 | 7/1956 | Godfrey | 222/494 |
| 3,129,919 | 4/1964 | Evans | 251/149.6 X |
| 3,144,237 | 8/1964 | Zurit et al. | 251/149.6 |
| 3,632,004 | 1/1972 | Grimes et al. | 215/349 X |
| 3,954,209 | 5/1976 | Ramond | 222/496 |
| 4,013,188 | 3/1977 | Ray | 215/347 |
| 4,109,815 | 8/1978 | Colins, III | 215/232 |
| 4,215,804 | 8/1980 | Giuffredi | 222/321 |
| 4,394,917 | 7/1983 | Looser | 215/232 |
| 4,396,655 | 8/1983 | Graham et al. | 215/232 X |
| 4,418,834 | 12/1983 | Helms et al. | 220/359 |
| 4,561,559 | 12/1985 | Rutan et al. | 220/203 |
| 4,733,786 | 3/1988 | Emslander | 215/230 |
| 4,757,914 | 7/1988 | Roth et al. | 220/359 |
| 4,810,541 | 3/1989 | Newman et al. | 428/36.7 |
| 4,909,434 | 3/1990 | Jones et al. | 229/125.15 |

*Primary Examiner*—Stephen Marcus
*Assistant Examiner*—Stephen Cronin
*Attorney, Agent, or Firm*—Ladas & Parry

[57] ABSTRACT

A cap device to be mounted to a mouthpiece of a container, in one aspect, comprises a cap member provided with an inner hollow portion and a film member accommodated in the inner hollow portion. The film member has a laminated structure composed of at least one metal including layer and a fusing layer abutting against an open end face of the mouthpiece mounted to the container. The cap device mounted to the mouthpiece is sealed by heating the film member by the high frequency induction heating treatment to fuse the fusing layer at the open end face of the mouthpiece. After the sealing, the cap device is removed and a connector means is connected to the mouthpiece and a pressure is applied to break the film member to establish the communication between an interior of the container and a connection line. In another aspect, a cap device comprises a connecting portion connected to the mouthpiece having an inner hollow portion and a coupling projecting portion having an inner through hole in which a movable valve member is disposed to be axially slidable. The interiors of the container, the connecting portion, the projecting portion and the outer connection line are communicated with each other through the movement of the movable valve member.

10 Claims, 14 Drawing Sheets

CAP DEVICE FOR MOUTHPIECE OF CONTAINER AND METHODS OF SEALING MOUTHPIECE PORTION OF CONTAINER AND OPENING THE SAME

BACKGROUND OF THE INVENTION

This invention relates to a cap device for sealing a mouthpiece of a container such as a bag-in-box which is required to have sterilizing ability and methods of sealing a mouthpiece portion of the container by utilizing the cap device and opening the same.

There is known a container which is required to be hermetically sealed and, as one example of the container of this character, is known so-called a bag-in-box of the type in which a foldable plastic bag container is accommodated in a corrugated fiberboard box for an outer package so as to utilize the box as a container suitable for conveying and reserving liquid content.

It is important to keep the sterilized condition for drink liquid and chemical liquid in a case where such liquids are fed into the bag-in-box of the character described above. In addition, for such a bag-in-box, it is also required to be easily used and handled. Accordingly, the bag-in-box container and the cap device are subjected to sterilizing treatment (for example, irradiation of γ-ray) beforehand. Many improvements for the structure of the cap device have been made for this purpose. However, almost all existing cap devices are constructed as single unit caps.

In the prior technique, in the actual usage of the bag-in-box container which is filled up with liquid under sterilized condition, a cap is manually removed and a mouth portion of the bag-in-box is then connected to a take-out jig such as a connector to take out the liquid in the bag-in-box. Accordingly, a mouthpiece of the bag-in-box container is temporarily directly exposed to an outer atmosphere at a time of being connected to the connector and there may cause a case where the outer atmosphere is intruded into the bag-in-box container or air of a head space in the container is flown out.

In view of the maintenance of the sterilization of the bag-in-box, it is not desired that the mouth portion is directly exposed to the outer atmosphere even in temporarily and many technical attempts have been tried to eliminate this problem.

A certain conventional cap device for the container such as bag-in-box is provided with a function as a connector. Such cap device is provided with a connector member to which a coupling member is connected to thereby form a dispenser means (external connection line) for optionally taking out the content in the bag-in-box. For the bag-in-box container of this type, it is also required to be provided with the sterilization maintaining property.

However, the connector member of the mouthpiece of the conventional cap device is, in general, sealed by one valve member. Therefore, when the dispenser means is assembled by connecting the coupling member to the connector member as described above, the content in the bag-in-box is always communicated with contaminated portions of the connector member and the coupling member.

The insufficient control of the dispenser means to microorganisms may be resulted, in an adverse case, in the degradation of the content or food poisoning for a person.

SUMMARY OF THE INVENTION

An object of this invention is to substantially eliminate the defects and drawbacks encountered to the prior art described above and to provide cap devices to be mounted to mouthpiece portions of containers and methods of sealing and opening the mouthpiece capable of maintaining suitable sterilized and sanitary condition of the mouthpiece portion during the connection of the cap device and the usage thereof.

This and other object can be achieved according to this invention, in one aspect, by providing a cap device to be mounted to a mouthpiece of a container, comprising a cap member provided with an inner hollow portion and a film member accommodated in the inner hollow portion of the cap member, the cap member being provided with a projection formed on an inner surface thereof and projecting inwardly of the inner hollow portion for temporarily supporting the film member in the inner hollow portion to prevent the film member from falling therefrom and the film member comprising a layered structure composed of at least one metal including layer and a fusing layer abutting against an open end face of the mouthpiece mounted to the container.

In another aspect of this invention, there is provided a cap device to be mounted to a mouthpiece of a container, comprising a connecting portion to be connected to the mouthpiece of the container, the connecting portion being provided with an inner hollow portion, a coupling projecting portion formed integrally with the connecting portion and adapted to be connected to an external connection line, the coupling projecting portion being provided with an axial through hole communicated with the inner hollow portion of the connecting portion, and a movable valve member disposed in the axial through hole to be axially movable. The movable valve member comprises a first seal member for sealing one end of the through hole of the coupling projecting portion, a second seal member for sealing the other end of the through hole and an elastic member disposed between the first and second seal members for outwardly urging the first and second seal members.

In a further aspect of this invention, there is provided a cap device to be mounted to a mouthpiece of a container, comprising a connecting portion provided with an inner hollow portion to be connected to the mouthpiece of the container, a coupling projecting portion integrally connected to the connecting portion and adapted to be connected to an external connection line, the coupling projecting portion being provided with an inner axial through hole communicated with the inner hollow portion of the connecting portion, a film member accommodated in the inner hollow portion of the connecting portion, and a movable valve member accommodated in the through hole of the coupling projecting portion to be axially expandable and shrinkable, the film member having a layered structure composed of two fusing layers constituting inner and outer layers of the film member and at least one metal including layer disposed between the two fusing layers.

In a still further aspect of this invention, there is provided a method of sealing a mouthpiece of a container by a cap device comprising a cap member provided with an inner hollow portion and a film member accommodated in the inner hollow portion of the cap member, the film member having a layered structure composed of a fusing layer abutting against an opening end face of the mouthpiece of the container and at least one metal including layer and the cap member being provided with a projection formed on an inner surface thereof and projecting inwardly of the inner hollow portion for temporarily supporting the film member in the inner hollow portion, the method being characterized by comprising the steps of mounting the cap device to the mouthpiece of the container with the film member being accommodated in the inner hollow portion of the cap member, heating the film member by means of high frequency induction heating to heat the metal including layer and fuse the fusing layer and sealing the open end face of the mouthpiece of the container with the fused fusing layer.

In a still further aspect of this invention, there is provided a method of opening a mouthpiece of a container from a cap device, after sealing the same, comprising a cap member provided with an inner hollow portion and a film member accommodated in the inner hollow portion of the cap member, the film member having a layered structure composed of a fusing layer abutting against an open end face of the mouthpiece of the container and at least one metal including layer and the cap member being provided with a projection formed on an inner surface thereof and projecting inwardly of the inner hollow portion for temporarily supporting the film member in the inner hollow portion, the method being characterized by comprising the steps of removing a cap member, connecting a connection line to the mouthpiece portion and applying a pressure to the film member from either one of outer and inner sides of the container to break the film member to thereby establish communication between an interior of the container and the connection line without being exposed to an atmosphere.

In a still further aspect of this invention, there is provided a method of opening a mouthpiece of a container from a cap device, after sealing the same, comprising a cap member provided with an inner hollow portion and a film member accommodated in the inner hollow portion of the cap member, the film member having a layered structure composed of a fusing layer abutting against an open end face of the mouthpiece of the container and at least one metal including layer and the cap member being provided with a projection formed on an inner surface thereof and projecting inwardly of the inner hollow portion for temporarily supporting the film member in the inner hollow portion, the method being characterized by comprising the steps of preparing a connector having a cutter and a connection line, removing the cap member, connecting the connector to the mouthpiece of the container so that the cutter is directed to the film member, connecting the connection line to an outer end of the connector, projecting the cutter towards the film member to break the film member to thereby establish communication between an interior of the container and the connection line without being exposed to an atmosphere.

In a still further aspect of this invention, there is provided a method of sealing a mouthpiece of a container by a cap device, after sealing the same, comprising a connecting portion provided with an inner hollow portion to be connected to the mouthpiece of the container, a coupling projecting portion integrally connected to the connecting portion and adapted to be connected to an external connection line, the coupling projection portion being provided with an inner axial through hole communicated with the inner hollow portion of the connecting portion and a film member accommodated in the inner hollow portion of the connecting portion, the film member having a layered structure composed of two fusing layers constituting inner and outer layers of the film member and at least one metal including layer disposed between the two fusing layers, the method being characterized by comprising the steps of mounting the cap device to the mouthpiece of the container with the film member being accommodated in the inner hollow portion of the connecting portion, heating the film member by means of high frequency induction heating to heat the metal including layer and fuse the fusing layers to an open end face of the mouthpiece and a top portion of the inner hollow portion of the connecting portion of the cap device and sealing the mouthpiece of the container with the fused fusing layers of the film member.

In a still further aspect of this invention, there is provided a method of opening a mouthpiece of a container from a cap device, after sealing the same, comprising a connecting portion provided with an inner hollow portion to be connected to the mouthpiece of the container, a coupling projecting portion integrally connected to the connecting portion and adapted to be connected to an external connection line, the coupling projecting portion being provided with an inner axial through hole communicated with the inner hollow portion of the connecting portion, a film member accommodated in the hollow portion of the connecting portion, and a movable valve member accommodated in the through hole of the coupling projecting portion to be axially expandable and shrinkable, the film member having a layered structure composed of two fusing layers constituting inner and outer layers of the film member and at least one metal including layer disposed between the two fusing layers, the method being characterized by comprising the steps of preparing a connector having an inner hollow portion in which a projecting pin is provided, connecting a connector to an outer end portion of the coupling projecting portion so that the pin extends inward of the coupling projecting portion, applying a pressure to one end of the movable valve member by the pin to depress and open the one end thereof, applying a pressure to the film member from either one of outer and inner sides of the container to break the film member and open the other end of the movable member to thereby establish communication between an interior of the container and an outer connection line without being exposed to an atmosphere.

According to this invention of the characters described above, the cap device to be mounted to the mouthpiece portion of a container, preferably a bag-in-box container, has a structure hermetically mounted to the mouthpiece portion of the container. The mouthpiece portion can be easily sealed and opened without being exposed to the atmosphere, thus being sanitory and the content can be easily taken out. The connection line can also be connected to the cap device under the sterilized condition.

BRIEF DESCRIPTION OF THE DRAWINGS

For a better understanding of this invention and to show how the invention can be carried out, reference will be made, by way of preferred embodiments, to the accompanying drawings, in which.

DESCRIPTION OF THE PREFERRED EMBODIMENTS

This invention will be described in detail hereunder with reference to a cap device to be connected to a mouthpiece of a bag-in-box as one typical example of a cap device for the mouthpiece of a container in which liquid content is contained.

Figure 1:
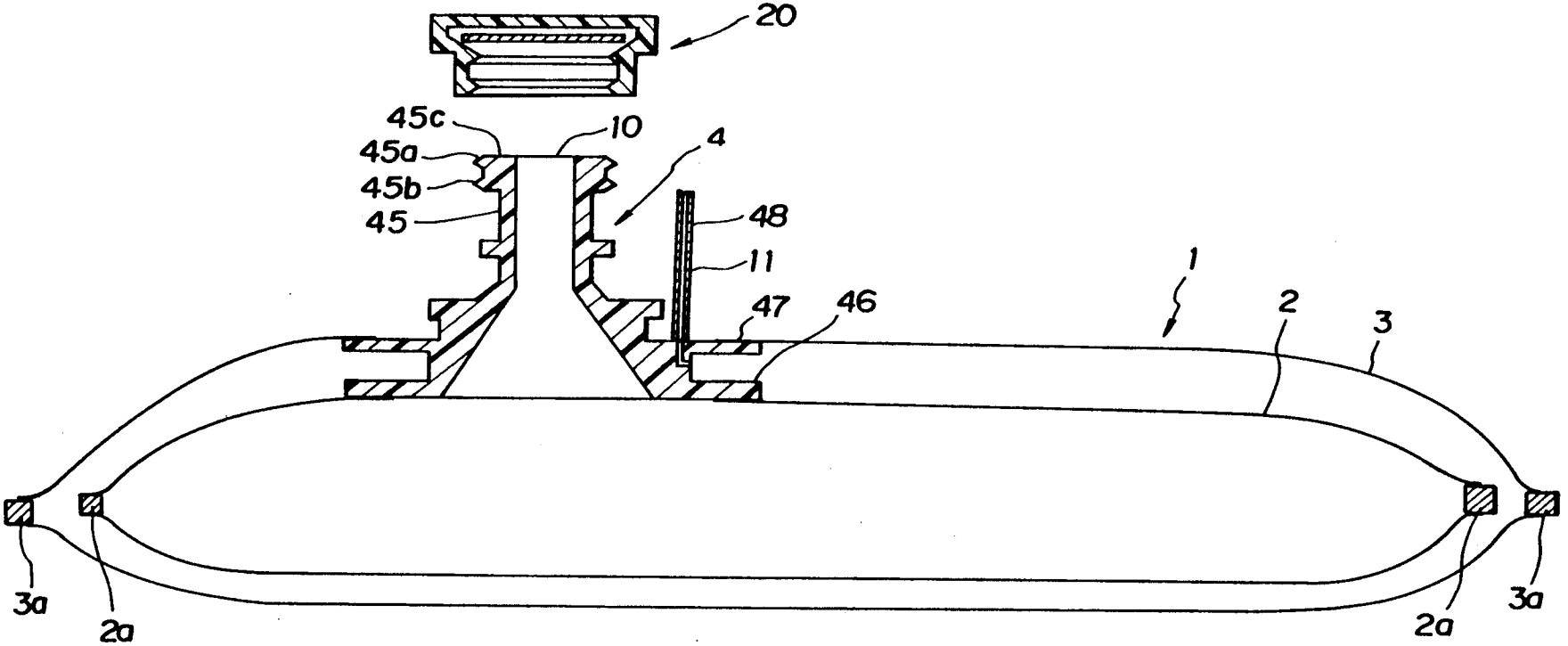
FIG. 1 is a longitudinal sectional view of a bag-in-box of double bag structure provided with a mouthpiece and a cap device of the first embodiment of this invention.

FIG. 1 shows a sectional view of a cap device 20, as the first embodiment of this invention, in a condition before the sealing of the cap device to a bag-in-box 1 provided with a connection mouthpiece 4.

The bag-in-box 1 is formed as a double-bag structure comprising an inner bag 2 and an outer bag 3 enclosing the inner bag 2, and the connection mouthpiece 4 of unitary structure for filling and taking out a content in and from the inner bag 2.

In the illustration of FIG. 1, an outer box as an outer package in which the bag-in-box 1 is accommodated is eliminated for the sake of convenience.

As shown in FIG. 1, the connection mouthpiece 4 comprises a cylindrical mouthpiece body 45, a lower flanged portion 46 as an adhesive portion for the inner bag 2 and an upper flanged portion 47 as an adhesive portion for the outer bag 3, the lower and upper flanged portions 46 and 47 being integrally formed to the lower and upper portions of the mouthpiece body 45. Two projections 45*a* and 45*b* in form of threads are formed to a portion near the periphery of the upper end of the mouthpiece body 45.

The mouthpiece body 45 is provided with a base portion from which a connection plug 48 is projected upwardly as viewed. The mouthpiece body 45 is also provided with an axial opening having relatively large diameter and communicating with an interior of the inner bag 2. The opening constitutes a communication hole 10 with respect to the inner bag 2 for filling the content into the inner bag 2 or taking out the content therefrom. Another hole having relatively small diameter is bored in the connection plug 48 and the mouthpiece body 45 so as to form a communication hole 11 with respect to the outer bag 3.

The inner and outer bags 2 and 3 are formed of a plastic film material such as polyethlene by forming the plastic film materials into multi-cylindrical portions having slightly mutually different inner diameters and the both open end portions of the cylindrical portions are heat fused by a heat sealer, for example, to form seal portions 2*a* and 3*a*, thus forming the plastic film materials into double bag structure.

The attachment of the mouthpiece 4 to the inner and outer bags 2 and 3 are performed by first forming holes to the film materials of the inner and outer bags 2 and 3 in vertical alignment, inserting the lower portion of the mouthpiece body 45 into these holes and then heat fusing the lower and upper flanged portions 46 and 47 of the lower portion of the mouthpiece body 45 to the film materials of the inner and outer bags 2 and 3.

The cap device 20 of the first embodiment of this invention to be mounted to the connection mouthpiece 4 of the character described hereinabove will be described hereunder with reference to the accompanying drawings.

Figure 2:
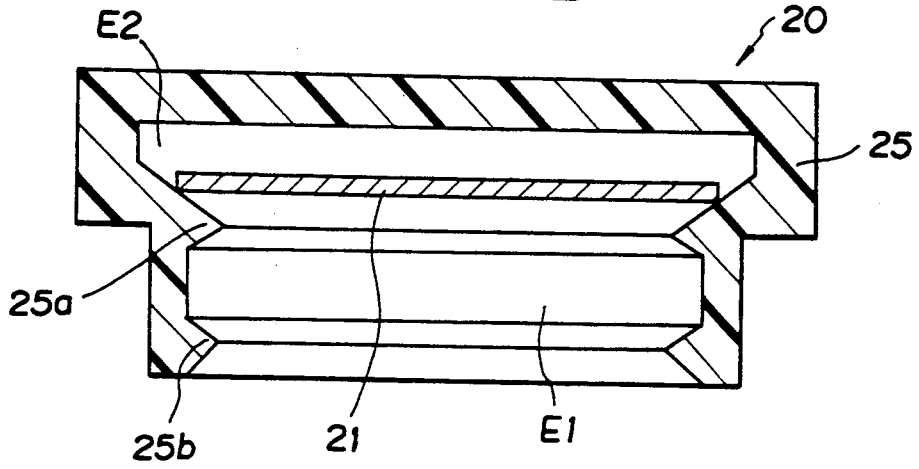
FIG. 2 is a sectional view, in an enlarged scale, of the cap device shown in FIG. 1.

Referring to FIG. 2, showing a sectional view of the cap device 20 before the mounting to the mouthpiece 4, the cap device 20 comprises an outer cap member 25 of substantially cylindrical shape having an inner hollow portion E1 and a film member 21 disposed in the inner hollow portion E1.

The film member 21 is of a disk-shape having flexibility and is directly contacted to an open end face 45*c* of the mouthpiece 4 as described hereunder.

Figure 3:
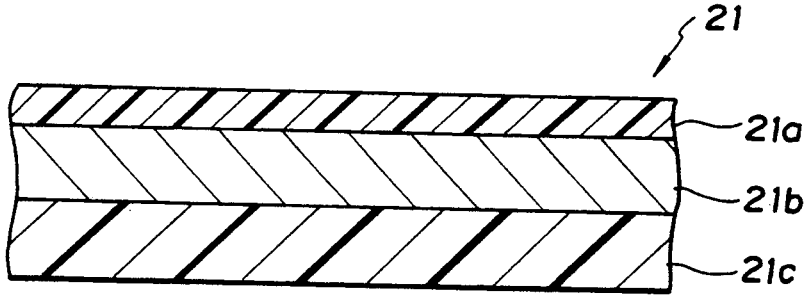
FIGS. 3 and 4 are sectional views showing layered structures of film members to be accommodated in the cap device shown in FIG. 2.

The film member 21, as shown in FIG. 3, has a laminated structure, for example, three-layered structure comprising a supporting layer 21*a*, a metal including layer 21*b* and a fusing layer 21*c* with the metal including layer 21*b* being interposed between the other two layers 21*a* and 21*c*.

In a preferred example, the metal including layer 21*b* may be formed of an aluminum foil having a thickness of about 30 μm or a material made by blending metal particles into resin material. The metal including layer 21*b* attains its function when the film member 21 is subjected to high frequency fusing treatment.

The supporting layer 21*a* may be made of a resin material having a flexibility such as polyethylene terephthalate (PET) having a thickness of about 15 μm.

It is preferred to form the fusing layer 21*c* with the same material as that constituting the mouthpiece 4 for the reason that the fusing layer 21*c* is fused to the open end face 45*c* of the mouthpiece 4. For this reason, the fusing layer 21*c* may be formed of polyethylene (PE) having thickness of about 45 μm.

The film member 21 is not limited to the three-layered structure and, in an alternation, the supporting layer 21*a* may be removed or the film member 21 may be formed to have multilayered structures having more than four layers by interposing other intermedicate layers as occasion demands.

Figure 4:
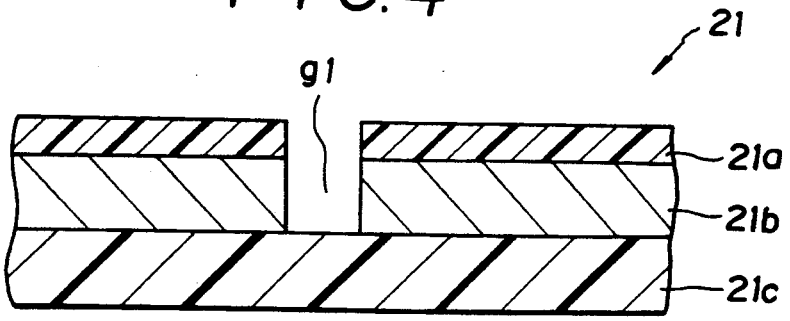

As shown in FIG. 4, it may be desired to form a recess g1 having a shape of cutout groove, for example, in a portion of the flat surface of the film member 21 (it is preferred to form the recess g1 without cutting the fusing layer 21*c*) for providing a suitable seal opening function as described hereunder. In an alternation, the supporting layer 21*a* and the fusing layer 21*c* may be cutout without cutting out the metal including layer 21*b*.

The cylindrical outer cap member 25 has two projections 25*a* and 25*b* projected inwardly of the inner hollow portion E1 so that the flexible film member 21 is disposed temporarily, without being dripped out, in an uppermost space E2 as viewed in the inner hollow portion E1. Namely, since the inner diameter of the upper projection 25*a* is slightly smaller than the outer diameter of the flexible film member 21, the film member 21 forcibly fitted into the space E2 cannot be easily dropped out.

The second embodiment of the cap device provided with a connection means, i.e. connector, according to this invention will be described hereunder with reference to the accompanying drawings.

Figure 5:
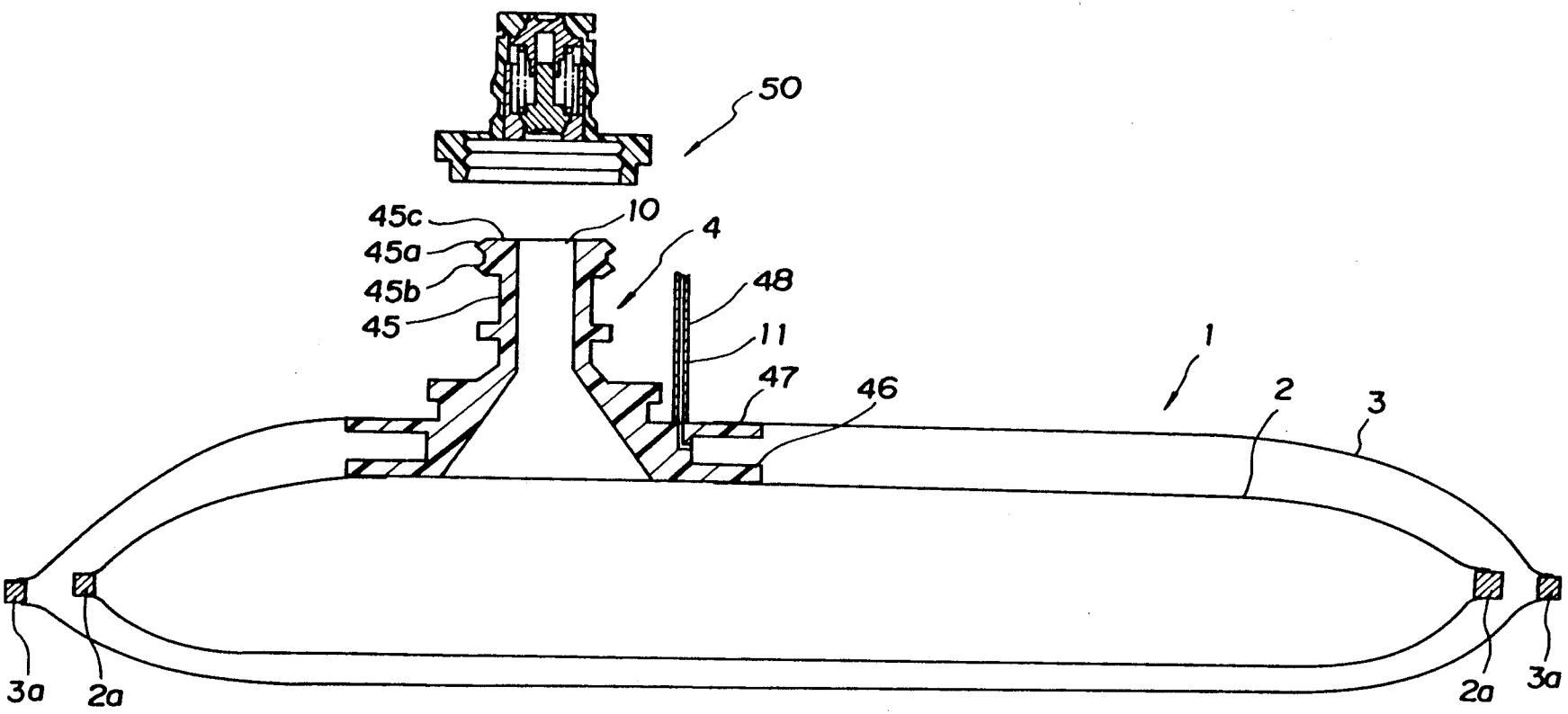
FIG. 5 is a longitudinal sectional view of a bag-in-box of double bag structure provided with a mouthpiece and a cap device of the second embodiment of this invention.

FIG. 5 is a sectional view of the bag-in-box container 1 of double bag structure provided with the connection mouthpiece 4 and a cap device 50, before the sealing, according to the second embodiment of this invention.

Referring to FIG. 5, the structure of the bag-in-box 1 of this embodiment is substantially the same as that of the first embodiment, so that the details thereof are omitted herein and, accordingly, the cap device 50 to be mounted to the mouthpiece 4 of the bag-in-box 1 is now described hereunder.

Figure 6:
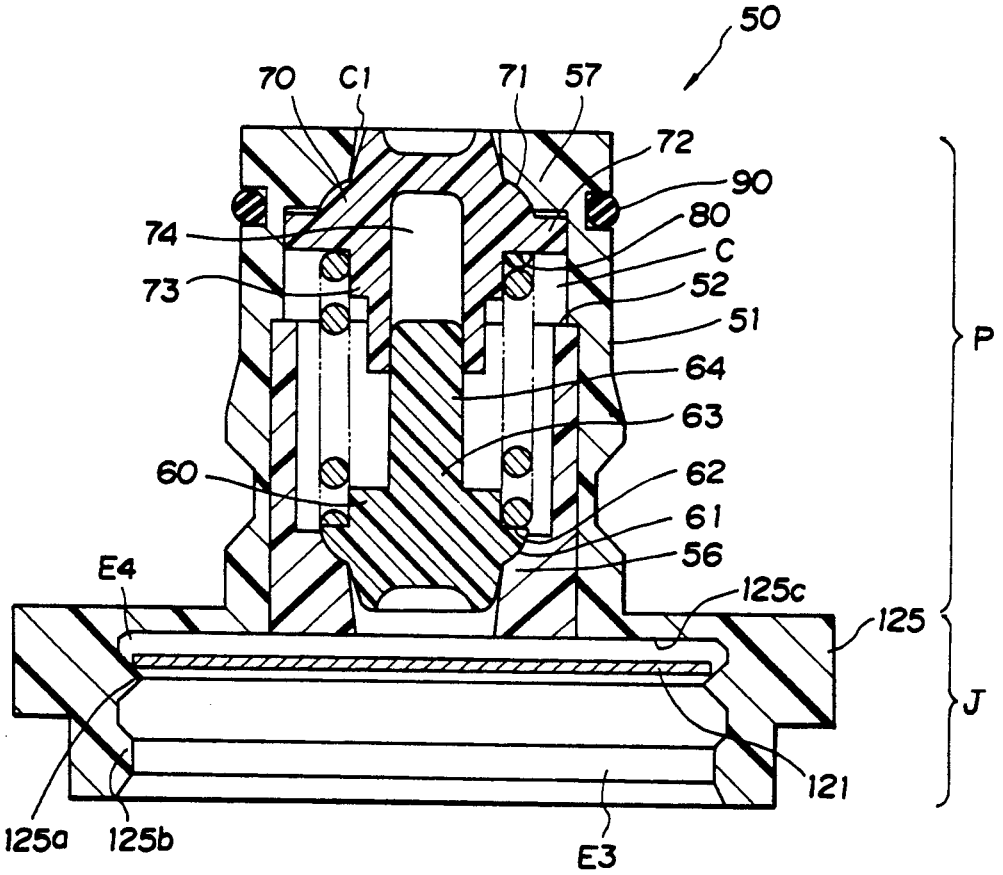
FIG. 6 is a sectional view, in an enlarged scale, of the cap device shown in FIG. 5.

FIG. 6 is an enlarged sectional view of the cap device 50 according to the second embodiment before the mounting to the mouthpiece 4. The cap device 50 comprises a connection portion J to be connected to the mouthpiece 4 of the bag-in-box container and a coupling portion P formed integrally with the connection portion J so as to extend upwardly as viewed.

The connection portion J is provided with an inner hollow portion E3 into which the mouthpiece 4 is inserted. In a preferred example, a flexible film member 121 is disposed in the hollow portion E3. The connection portion J is also provided with two projections 125*a* and 125*b*, for example, so as to project inwardly of the hollow portion E3 as described with reference to the first embodiment as the projections 25*a* and 25*b*, and the disk-shaped flexible film member 121 is temporarily disposed in an uppermost space E4 in the hollow portion E3. Since the inner diameter of the projection 125*a* is slightly smaller than the outer diameter of the flexible film member 121, the film member 121 forcibly inserted into the space E4 cannot be easily dropped out.

Figure 7:
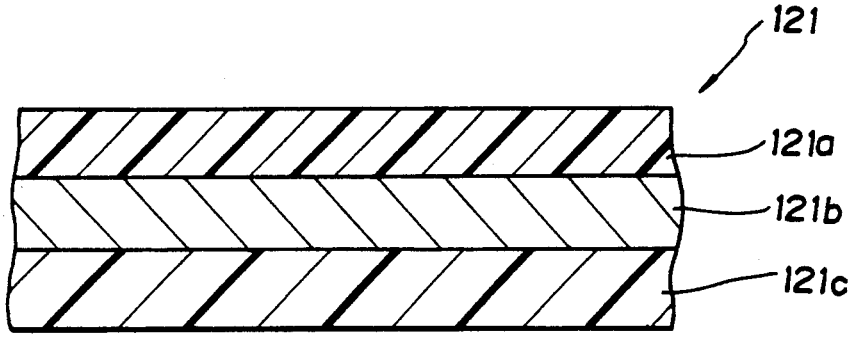
FIGS. 7 and 8 are sectional views showing layered structures of film members to be accommodated in the cap device shown in FIG. 6.

As shown in FIG. 7, the film member 121 has a laminated structure, for example, three-layered structure comprising a fusing layer 121*a*, a metal including layer 121*b* and a fusing layer 121*c* with the metal including layer 121*b* being interposed between the other two fusing layers 121*a* and 121*c*.

In a preferred example, the metal including layer 121*b* may be formed of an aluminum foil having a thickness of about 30 μm or a material made by blending metal particles into resin material. The metal including layer 121*b* attains its function when the film member 121 is subjected to high frequency induction heating and fusing treatment as described with reference to the first embodiment.

The fusing layers 121*a* and 121*c* abut against the top surface 125*c* of the hollow portion E3 (FIG. 6) and the open end face 45*c* (FIG. 5) of the mouthpiece 4 and both of the layers are heat fused in this state. For this purpose, it is desired to form the fusing layers 121*a* and 121*c* with the same material as that forming the connection portion J and the mouthpiece 4. For this reason, the fusing layers 121*a* and 121*c* may be formed of polyethylene (PE) each having thickness of about 45 μm.

The film member 121 is not limited to the three-layered structure and, in an alternation, the film member 121 may be formed to have laminated structure having more than four layers by interposing other intermediate layers as occasion demands.

Figure 8:
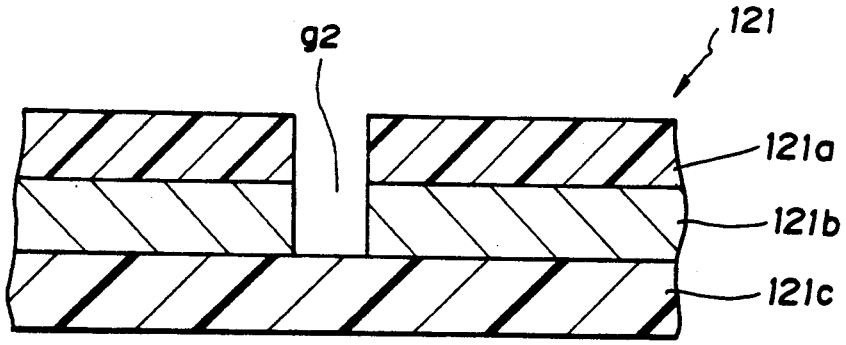

As shown in FIG. 8 and as described with reference to the first embodiment, it may be desired to form a recess g2 having a shape of linear cutout groove, for example, in a portion of the flat surface of the film member 121 (it is preferred to form the recess g2 without cutting the fusing layer 121*c*) for providing a suitable seal opening function. In an alternation, the fusing layers 121*a* and 121*c* may be cutout without cutting out the metal including layer 121*b* and, in such a case, substantially identical preferable effect may be attained.

The coupling portion P of the cap device 50 shown in FIG. 6 is provided with an inner axial through hole C in which is disposed an axially expandable valve member having both end openings optionally opened and closed.

The end, lower end as viewed, of the through hole C is communicated with the inner hollow portion E3 of the connection portion J of the cap device 50 so that the wall portion of this end portion forms a valve seat 56 having a predetermined curved surface. In the like manner, the wall portion of the other end portion of the through hole C forms a valve seat 57 having a predetermined curved surface.

A ring-shaped engaging portion 52 is formed to the intermedicate wall portion of the through hole C and, as described hereunder, the engaging portion 52 abuts, in an engaged manner, against a projection 72 of a second seal member 70.

The movable valve member disposed in the through hole C having the structure described above is composed of a first seal member 60 for sealing the one end of the through hole C, the second seal member 70 for sealing the other end of the through hole C and an elastic member 80, in form of spring in the illustration of FIG. 6, disposed between the first and second seal members 60 and 70 for outwardly urging these seal members.

The first seal member 60 comprises a sealing portion 61 having a predetermined curved surface suitable for attaining the abut-sealing function to the valve seat 56 formed as a stepped portion at one end portion of the through hole C and a base portion 63 provided with a cylindrical slidable portion 64 integrally projecting from the sealing portion 61. A flanged portion 62 is integrally formed to the sealing portion 61.

Figure 9A:
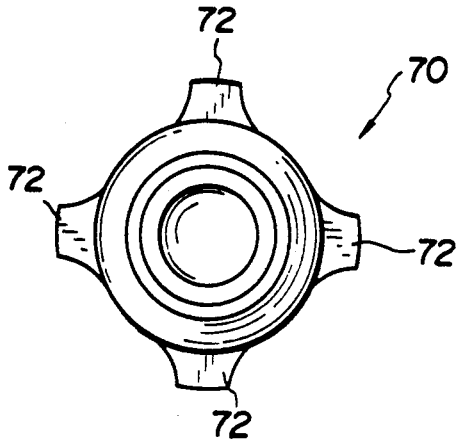
FIGS. 9A and 9B are plan and sectional views of the second sealing member of the cap device shown in FIG. 6.
Figure 9B:
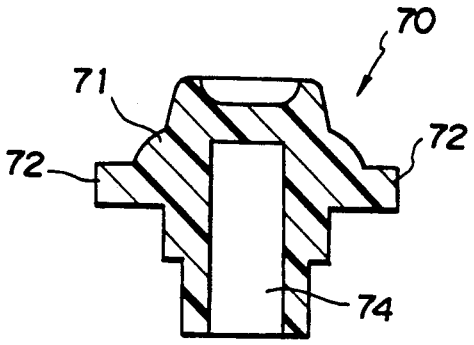

The second seal member 70 comprises a sealing portion 71 having a predetermined curved surface suitable for attaining the abut-sealing function to the valve seat 57 formed as a stepped portion at the other end portion of the through hole C and a base portion 73 provided with a cylindrical slidable portion 74, having an inner hollow portion, integrally projecting from the sealing portion 71. Four projections 72 are formed on the outer periphery of the base portion 73. FIG. 9 shows the state described above in which the projected projections 72 abut against the ring-shaped engaging portion 52 when the second seal member 70 is depressed in the through hole C.

The inner hollow portion of the slidable portion 74 of the second seal member 70 has a shape corresponding to the outer shape of the slidable projection 64 of the first seal member 60 and when the projection 64 is slidably fitted into the inner hollow portion of the slidable portion 74, the first and second seal members 60 and 70 are integrally engaged. The location of the elastic member 80 is disposed between the flanged portion 62 of the first seal member 60 and the projections 72 of the second seal member 70 so as to always urge outwardly both the seal members. In a preferred example, a coil spring may be utilized for the elastic member 80.

Figure 10:
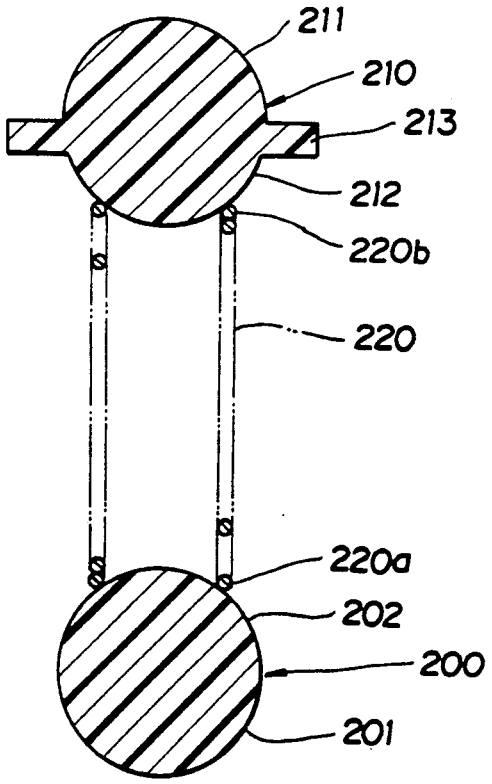
FIG. 10 is a sectional view of a modified example of a movable valve member of the cap device shown in FIG. 6.
Figure 11A:
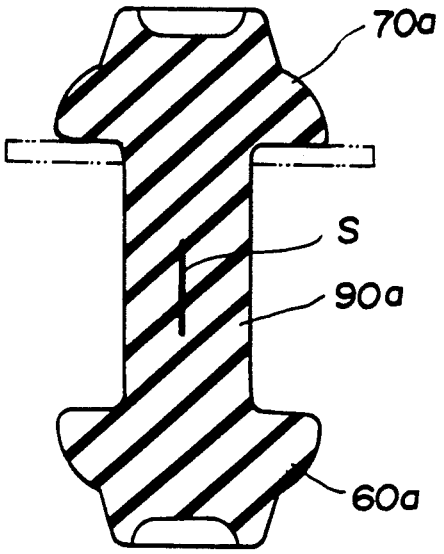
FIGS. 11A and 11B are sectional views of another modified example of the movable valve member.

FIGS. 10 and 11 represent modifications of the movable valve member utilized for the cap device 50 of the second embodiment of this invention.

The movable valve member shown in FIG. 10 is composed of a first seal member 200 for sealing one end of the through hole C, a second seal member 210 for sealing the other end of the through hole C and an elastic member 220 in form of coil spring disposed between the first and second seal members 200 and 210 so as to outwardly urge these seal members.

The first seal member 200 of substantially spherical shape comprises an outer sealing portion 201 to seal the through hole C in abutment against one end thereof formed as a stepped portion and an inner engaging portion 202 so as to abut against one end 220*a* of the coil spring 220. The second seal member 210 of substantially spherical shape comprises an outer sealing portion 211 to seal the through hole C in abutment against the other end thereof formed as a stepped portion and an inner engaging portion 212 so as to abut against the other end 220*b* of the coil spring 220.

In this embodiment, since the sealing surface is formed to be spherical, the improved sealing effect can be attained. It is desired to form a ring-shaped projection 213 on the peripheral surface of the second seal member 210 as shown in FIG. 10 for the purpose of achieving accurate abutting engagement with the engaging portion 52 of the through hole C.

Figure 11B:
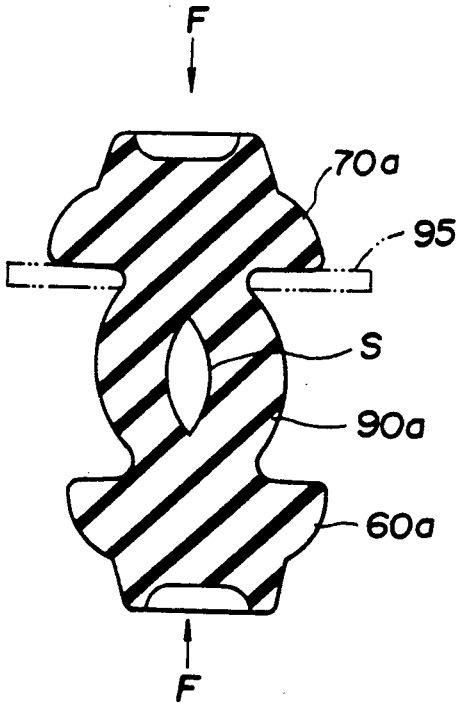

The movable valve member shown in FIG. 11 comprises a first sealing portion 60*a* for sealing one end, formed as a stepped portion, of the through hole C, a second sealing portion 70*a* for sealing the other end, formed as a stepped portion, of the through hole C and a connecting portion 90*a* in shape of column connecting the first and second sealing portions 60*a* and 70*a*. These first and second sealing portions 60*a* and 70*a* and the connecting portion 90*a* are integrally formed of an elastic material. In addition, as occasion demands, it may be desired to form a linear slit S as an elongated hole in the connecting portion 90*a* so as to extend in the axial direction thereof for easily laterally expanding the movable valve member. Namely, as shown in FIG. 11B, when an axial, vertical as viewed, force is applied to the movable valve member from axial one or both ends thereof, the movable valve member is axially shrunk while laterally expanding the slit S.

As the elastic material for the movable valve member shown in FIG. 11, is utilized a various kind of elastomers such as natural rubber, synthetic rubber or plastic material having elasticity. It is desired as shown in FIG. 11 to disposed a rigid disk-shaped washer 95 to the neck portion of the second sealing portion 70*a* for achieving the firm abutting engagement with the engaging portion 52 of the through hole C.

The usage of the integrated elastic material as the movable valve member can effectively eliminate assembling processes thereof and reduce parts or elements to be composed, resulting in the improvement of the quality of the product as well as the decreasing of cost.

Hereinafter, a method of sealing, after filling the content in the inner bag 2, the cap devices according to the first and second embodiments described hereinbefore to the mouthpiece of the bag-in-box container will be explained.

First, a method of sealing the cap device 20 of the first embodiment to the mouthpiece 4 of the bag-in-box 1 will be described with reference to FIGS. 12A to 12F.

Figure 12A:
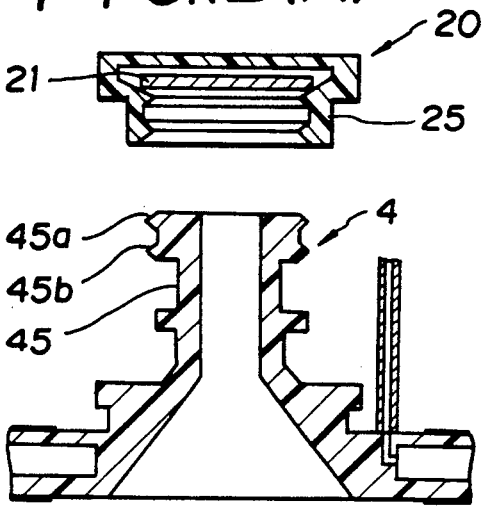
FIGS. 12A to 12F are sectional views of the cap device of the first embodiment for the explanatory of the cap device sealing and opening method in respective steps.

As shown in FIG. 12A, the cap device 20 having the cap member 25 having the inner hollow portion in which the film member 21 is accommodated is first prepared.

Figure 12B:
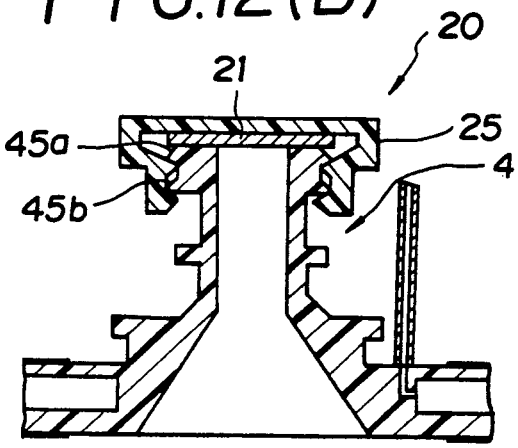

Next, as shown in FIG. 12B, the cap device 20 is fitted to the mouthpiece 4 of the bag-in-box container 1 so as to maintain the inner sealed condition from the outer atmosphere by the locations of two projections 45*a* and 45*b* formed on the outer periphery of the mouthpiece 4 and the two projections 25*a* and 25*b* formed on the inner periphery of the inner hollow portion of the cap member 25.

Under such fitted condition and the no-filling condition of the content, the sterilizing process by use of γ-ray, for example, is performed.

Figure 12C:
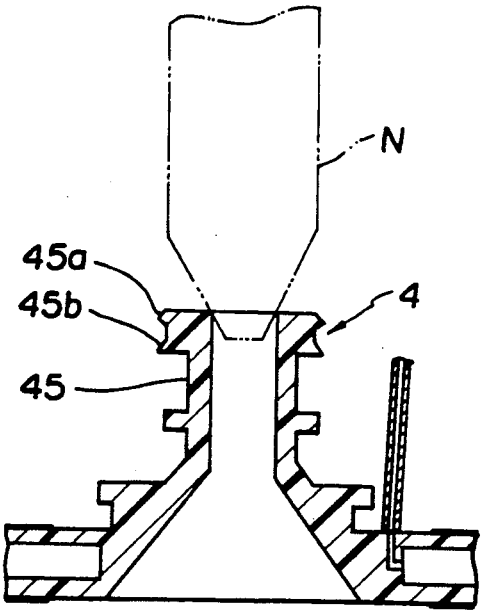

Thereafter, as shown in FIG. 12*c*, the cap device 20 is separated from the mouthpiece 4 by mechanical means, not shown, while maintaining the sterilized condition, and a sterilized nozzle member N is press connected to the mouthpiece 4 to fill the inner bag 2 with liquid such as sirup.

Figure 12D:
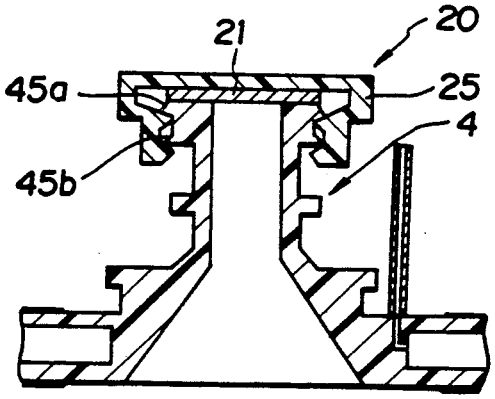

After the completion of the liquid filling, the cap device 20 is again fitted to the mouthpiece 4 as shown in FIG. 12D.

Figure 12E:
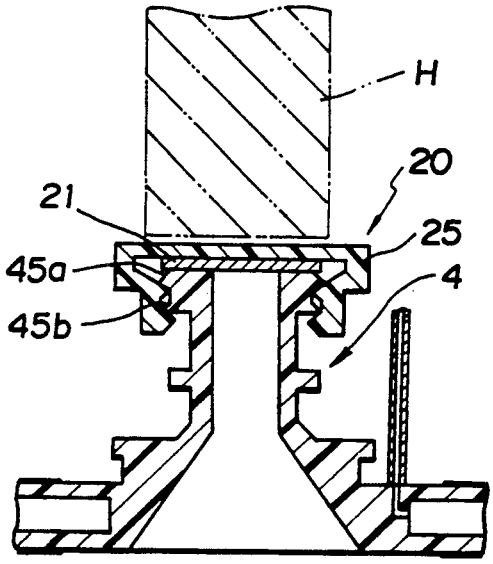

In the next step, as shown in FIG. 12E, the cap device 20 is moved to a station directly below a head H of a high frequency induction heating coil and the film member 21 disposed inside the cap device 20 is fused to the open end face 45*c* of the mouthpiece 4 by passing current through the high frequency induction heating coil having the head H which is lowered and pressed against the cap device 20 as shown in FIG. 12E. Namely, the metal including layer 21*b* of the film member 21 is heated by the high frequency heating treatment and accordingly the fusing layer 21*c* having a low melting point is fused hermetically to the open end opening face 45*c* of the mouthpiece 4.

Figure 12F:
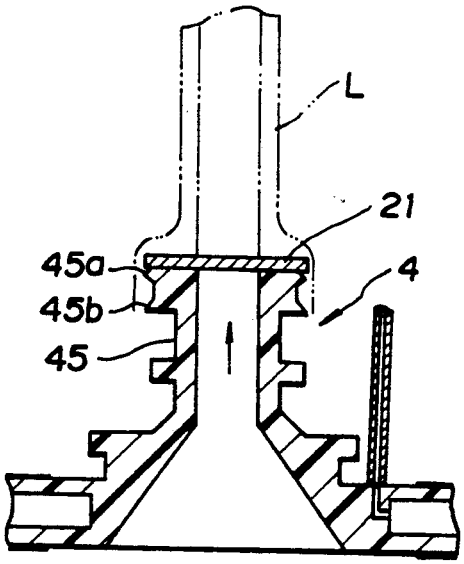

With reference to FIG. 12F, when it is required to take out the content such as sirup from the bag-in-box, the cap member 25 is quickly removed and the connector L, preliminarily sterilized, constituting a conduit line is fitted to the outer periphery of the top portion of the mouthpiece 4 in the sterilized manner. Thereafter, a pressure is additionally applied to the bag-in-box and a pressure is also applied to the film member 21, thus establishing the communication between the interior of the bag-in-box and the connector L without being exposed to the atmosphere, thus being sanitary.

According to the seal opening method described above, the liquid content in the bag-in-box can be taken out in the sterilized condition without being exposed to the atmosphere.

As described hereinbefore, for this seal opening and content take-out method, it is desired to preliminarily form the grooved cutout g1, as shown in FIG. 4, in the flat surface portion of the film member 21. The grooved cutout g1 may be formed by the irradiation of laser beam, for example.

Figure 13:
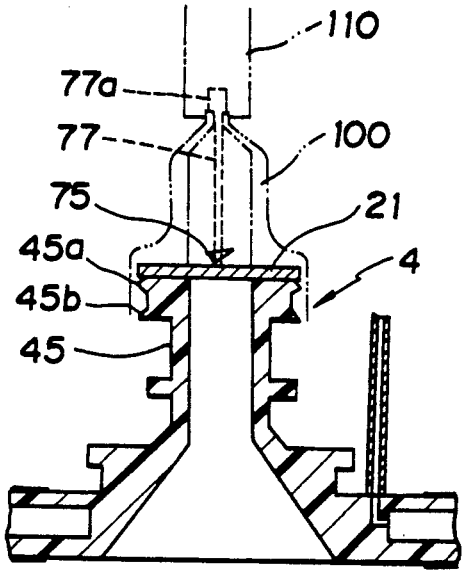
FIG. 13 is a sectional view of the cap device shown in FIG. 12 showing a condition that the film member is cut out by means of a cutter blade.
Figure 14A:
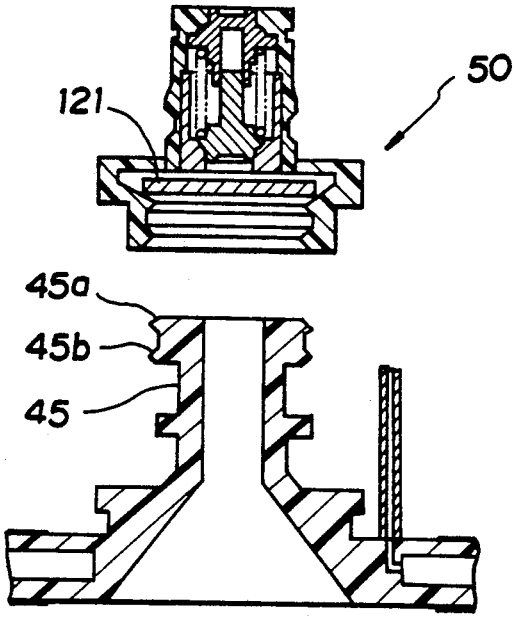
FIGS. 14A to 14E are sectional views of the cap device of the second embodiment showing conditions similar to those of FIGS. 12A to 12E.
Figure 14B:
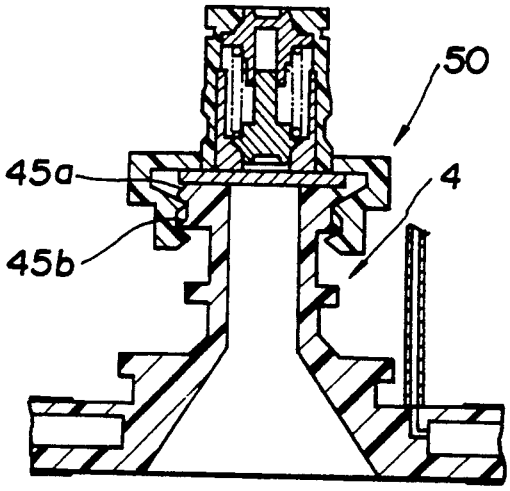
Figure 14C:
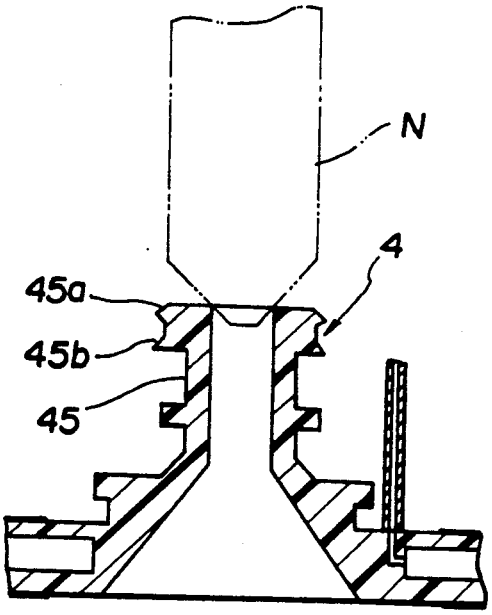
Figure 14D:
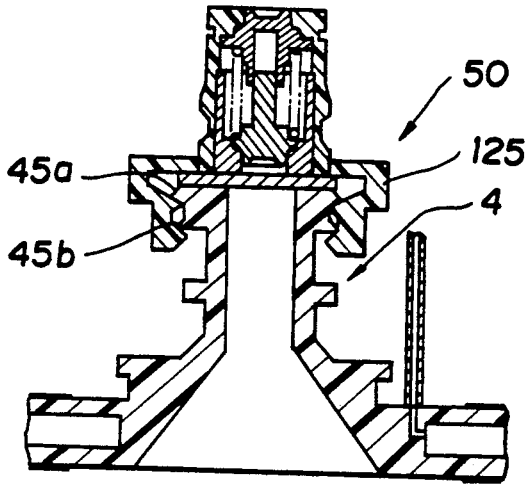
Figure 14E:
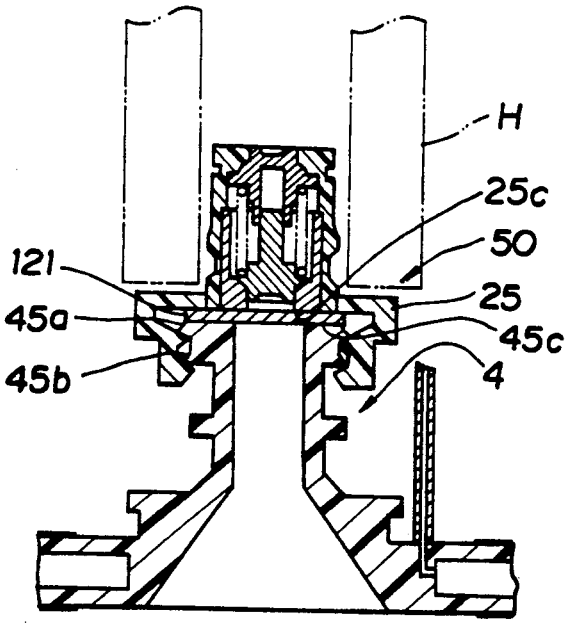

It is of course possible to break the film member 21 by using the butter blade for breaking the film member 21 is illustrated in FIG. 13. Referring to FIG. 13, a connector 100 to which a cutter blade 75 is equipped is connected to the mouthpiece 4 and a conduit line 110 is connected to the rear portion, upper portion as viewed, of the connector 100. The cutter blade 75 is projected forwardly, downwardly as viewed, by pushing the rear end 77*a* of a shaft 77 supporting the cutter blade 75, thereby breaking the film member 21 and establishing the communication between the interior of the bag-in-box and the conduit line 110.

As described above, although, in the prior art technique, the connecting portion of the cap device and the mouthpiece of the bag-in-box is exposed, even in temporarily, to the atmosphere, the adoption of the cap device and the sealing and seal opening methods according to this invention make it possible to communicate the interior of the bag-in-box with the connector under the completely sterilized condition.

According to this invention, since the bag-in-box can be hermetically connected to the connector in the sterilized condition, the sterilized condition of the connector line can be also maintained, thus achieving the remarkable effects in comparison with the prior art technique, particularly as the countermeasure to the microorganism.

Furthermore, according to this invention, the frequency of the sterilizing processes can be remarkably reduced during the feeding or taking out of the content such as drink solution in comparison with the prior art technique, thus making it possible to simplify the sanitary system and sterilizing working. Namely, the sanitation operation has been carried out every or every other day in the prior art technique, but, according to this invention, it was found that the sterilized condition can be effectively maintained by carrying out the sanitation operation every one or two weeks.

A method of sealing the cap device of the second embodiment described hereinbefore according to this invention will be described hereunder with reference to FIGS. 14A to 14E.

The basic principle of the method of mounting the cap device 50 represented by FIGS. 14A to 14E is substantially identical to that of the method of mounting the cap device 20 of the first embodiment represented by FIGS. 12A to 12F and the respective steps represented by FIGS. 14A to 14E substantially correspond to the steps represented by FIGS. 12A to 12E. The difference of the method of FIG. 14 from the method of FIG. 12 resides in that both surfaces of the film member 121 are fused respectively to the open end face 45*c* of the mouthpiece 4 and to the top surface 125*c* of the inner hollow portion E3 of the cap device 50 to thereby integrate the cap device 50 and the mouthpiece 4 through the film member 121. After the connection of the cap device 50 and other outer connection line, the film member 121 is broken by a liquid pressure caused by the application of the pressure applied to the bag-in-box, whereby the communication between the interior of the bag-in-box, and the connection couduit line can be achieved without being exposed to the atmosphere.

As described, according to this method, the liquid content filling the bag-in-box can be taken out without being exposed to the atmosphere in the sanitarily sterilized state.

As described hereinbefore, for this seal opening and content take-out method, it is desired to preliminarily form the groove cutout g2 may be formed by a cutter knife or irradiation of laser beam, for example.

The function or operation of the cap device 50 of the second embodiment at a time when the inner liquid such as sirup is taken out from the bag-in-box will be explained hereunder.

Figure 15:
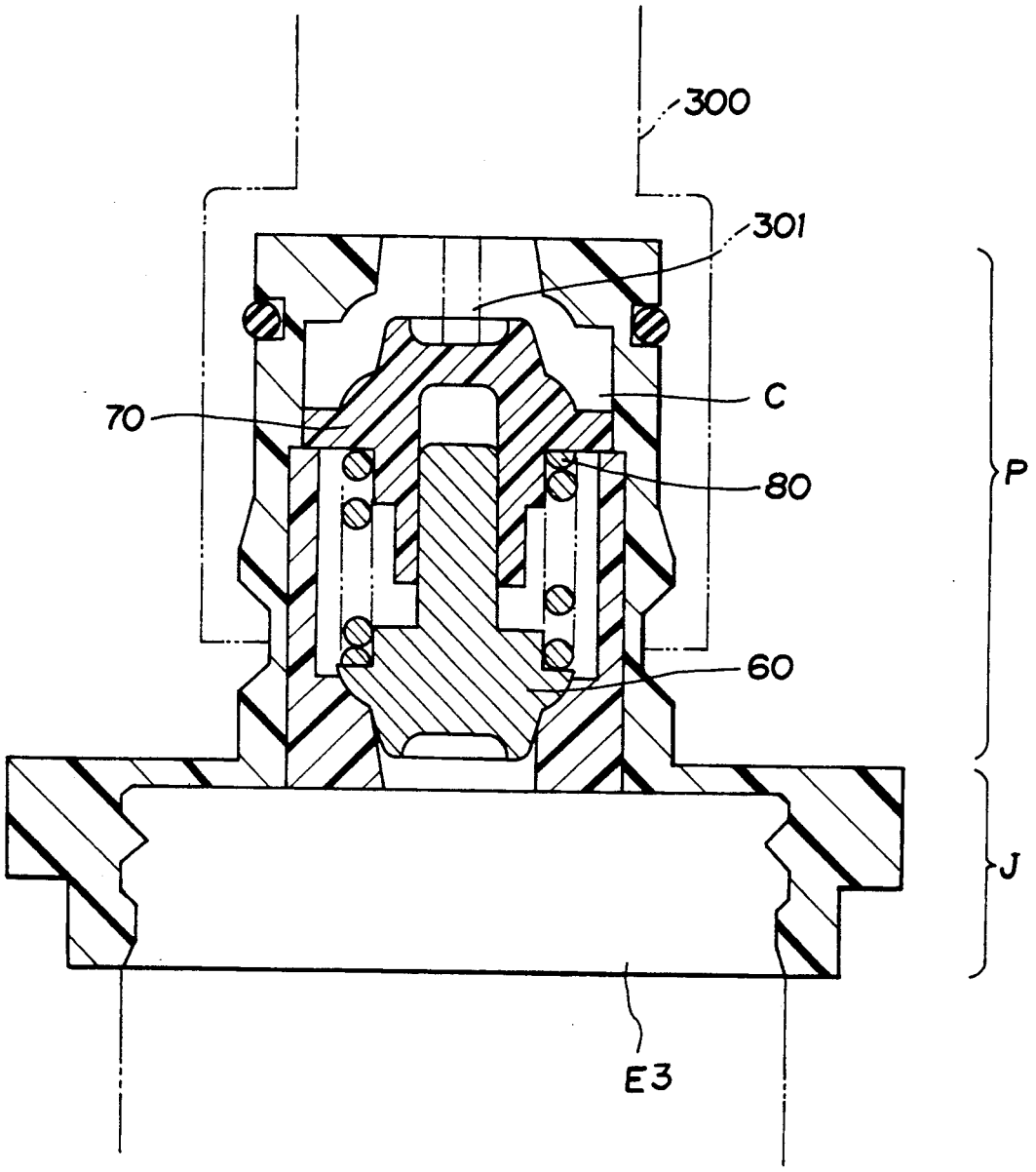
FIGS. 15 and 16 are sectional views of the cap device of the second embodiment for the explanatory of the operation of the movable valve member.

As shown in FIG. 15, a female connector 300 constituting one portion of an outer connection conduit line is fitted to the outer periphery of the coupling projection P of the cap device 50 by applying a force of about 7 kg to the connector 300. A rod-shaped pin 301 is provided in the inner hollow portion of the female connector 300 so as to axially down wardly extend as viewed at the substantially the central portion of the inner hollow portion. Accordingly, when the female connector 300 is press connected to the projection P of the cap device 50, the pin 301 depresses the second sealing member 70 of the cap device 50 thereby break the sealed condition of the upper end sealed portion.

Figure 16:
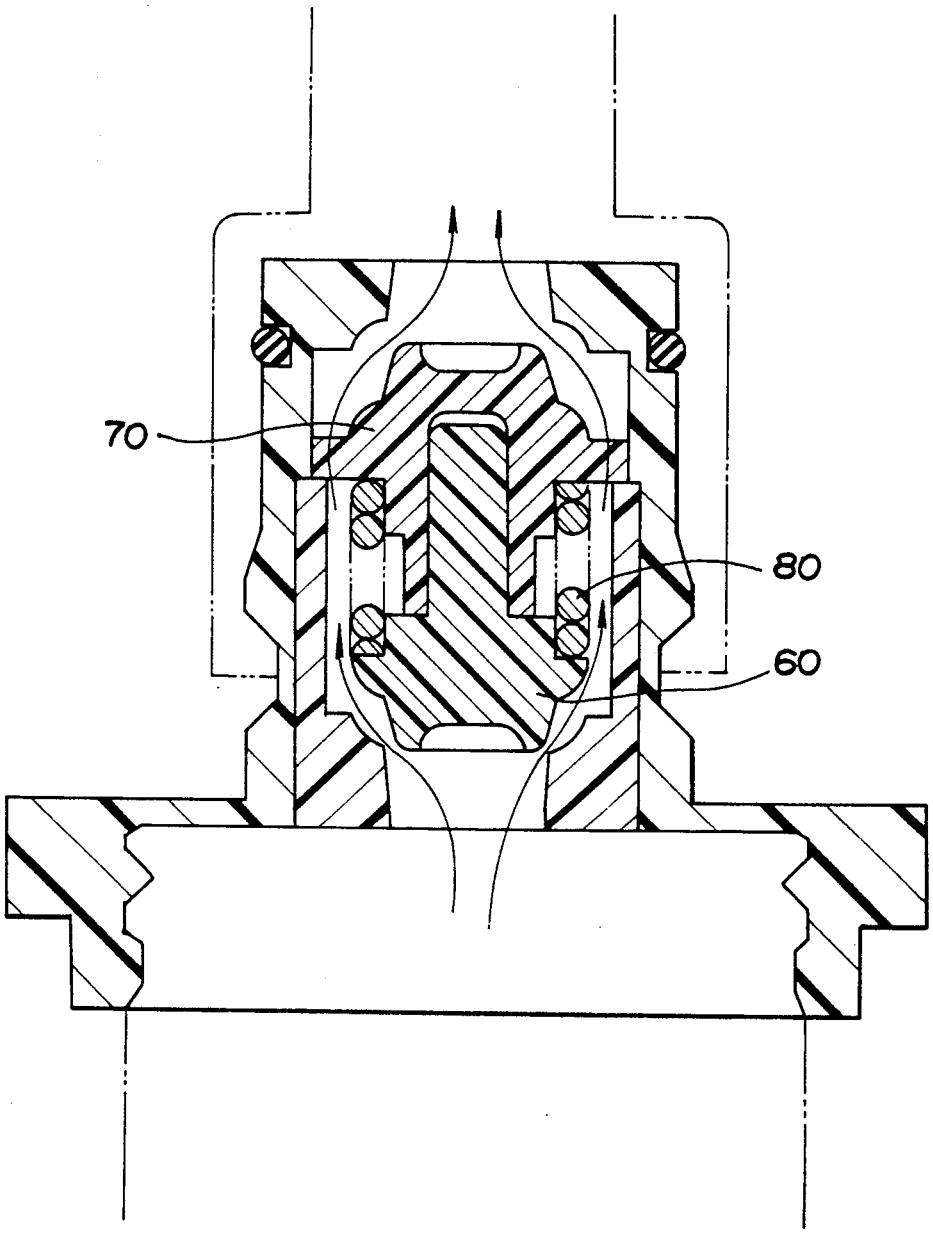

In the next step, as shown in FIG. 16, the first sealing member 60 is moved upwardly as viewed by the liquid pressure caused by the application of pressure to the bag-in-box, whereby the sealed condition of the other end sealed portion is released. In this process, if the film member 121 is hermetically contacted to the lower end face of the cap device 50, the film member 121 is broken by the liquid pressure, in thus manner, the communication between the interior of the bag-in-box and the connection conduit line being established. In such a case, the liquid pressure is in general of 0.5 kg/cm$^2$ and it is desired to utilize the coil spring 80 having an urging force suitable for this liquid pressure.

When the pressure application to the bag-in-box is stopped after the pouring of the predetermined amount of the liquid content, the sealing condition of the cap device 50 becomes to the state shown in FIG. 15. Since the interior of the bag-in-box is shut out from the connection conduit line by the first sealing member 60 during this operation, the content in the bag-in-box is not contaminated. Accordingly, in a time when the content is not taken out from the bag-in-box, the end portion of the through hole C on the side of the bag-in-box is always sealed by the first sealing member 60. As described above, the interior of the bag-in-box is hermetically shut out from the connection conduit line during the bag-in-box connecting process and the bag-in-box using time, whereby the content in the bag-in-box is substantially completely free from the contamination in comparison with the prior art technique.

In the foregoing descriptions, there were proposed examples in which the pressure is applied to the bag-in-box, but the embodiments of this invention can be carried out by sucking the content in the bag-in-box from the outer connection conduit line.

It is to be understood that this invention is not limited to the described embodiments and many other changes and modifications may be made without departing from the spirit of the appended claims and, for example, containers other than the bag-in-box container may be utilized.

What is claimed is:

1. A cap device to be mounted to a mouthpiece of a container, comprising:

a connecting portion to be connected to the mouthpiece of the container, said connecting portion being provided with an inner hollow portion;

a coupling projecting portion formed integrally with said connecting portion and adapted to be connected to an external connection line, said coupling projecting portion being provided with an axial through hole in communication with the inner hollow portion of said connecting portion; and a movable valve means disposed in said axial through hole to be axially movable, said movable valve means having a first seal member for sealing one end of the axial through hole of said coupling projecting portion, a second seal member for sealing the other end of the axial through hole and a coil spring disposed between said first and second seal members for outwardly urging said first and second seal members, wherein the first seal member and the second seal member are movable in an inward direction of the axial through hole, respectively, when the first seal member and the second seal member receive an external force larger than a force of the coil spring, respectively.

2. A cap device according to claim 1, wherein the axial through hole of said coupling projecting portion is provided with axial one and other end portions stepped inwardly and wherein said first seal member is provided with a sealing portion abutting against the stepped one end portion of the through hole and a base portion having a projection axially projected in the through hole, said second seal member is provided with a sealing portion abutting against the other stepped end portion of the through hole and a base portion having an inner hollow portion and at least a pair of guide portions projected outwardly from the periphery of the base portion, said projection of the base portion of said first seal member is slidably engaged with said inner hollow portion of the base portion of said second seal member so as to be axially slidable, and said pair of guide portions are slidably engaged with an inside wall of the axial through hole of said coupling projecting portion so as to be axially slidable therein.

3. A cap device according to claim 1, wherein a ring-shaped engaging portion is formed on the inside wall of the through hole so as to engage with the pair of guide portions of said second seal member.

4. A cap device to be mounted to a mouthpiece of a container, comprising:

a connecting portion provided with an inner hollow portion to be connected to the mouthpiece of the container;

a coupling projecting portion integrally connected to said connecting portion and adapted to be connected to an external connection line, said coupling projecting portion being provided with an inner axial through hole in communication with the inner hollow portion of said connecting portion;

a film member accommodated in the inner hollow portion of said connecting portion; and a movable valve means accommodated in the through hole of said coupling projecting portion to be axially moveable, said film member having a layered structure composed of two fusing layers constituting inner and outer layers of the film member and at least one metal including layer disposed between said two fusing layers.

5. A cap device according to claim 4, wherein said connecting portion is provided with a projection formed on an inner surface thereof and projecting inwardly of the inner hollow portion for temporarily supporting said film member to prevent the film member from falling therefrom.

6. A cap device according to claim 5, wherein a narrowest inner diameter of said projection is smaller than an outer diameter of said film member.

7. A cap device according to claim 5, wherein said film member is provided with a flat surface portion and a linear recess is formed in at least a part of the flat surface portion.

8. A cap device according to claim 4, wherein said movable valve means comprises a first seal member for sealing one end of the through hole of said coupling projecting portion, a second seal member for sealing the other end of the through hole and an elastic means disposed between said first and second seal members for outwardly urging said first and second seal members.

9. A cap device according to claim 8, wherein the through hole of said coupling projecting portion is provided with axial one and other end portions stepped inwardly, said first seal member being provided with a sealing portion abutting against the stepped one end portion of the through hole and a base portion having a projection, said second seal member being provided with a sealing portion abutting against the other stepped end portion of the through hole and a base portion having an inner hollow portion, said projection of the base portion of said first seal member being slidably engaged with said inner hollow portion of the base portion of said second seal member so as to be axially slidable.

10. A cap device according to claim 8, wherein said elastic means is a coil spring disposed between the sealing portions of said first and second seal members.

* * * * *